US006499819B2

(12) United States Patent
Hoeppner

(10) Patent No.: US 6,499,819 B2
(45) Date of Patent: Dec. 31, 2002

(54) DRAWER SLIDE

(75) Inventor: Daniel M. Hoeppner, Warsaw, IN (US)

(73) Assignee: Grace Manufacturing, Inc., Warsaw, IN (US)

( * ) Notice: Subject to any disclaimer, the term of this patent is extended or adjusted under 35 U.S.C. 154(b) by 0 days.

(21) Appl. No.: 09/818,319

(22) Filed: Mar. 27, 2001

(65) Prior Publication Data

US 2002/0140330 A1 Oct. 3, 2002

(51) Int. Cl.[7] ..... A47B 88/00
(52) U.S. Cl. ..... 312/334.44; 312/333; 312/334.46
(58) Field of Search ..... 312/333, 334.8, 312/334.27, 334.29, 334.32, 334.34, 334.44, 334.46; 384/21, 23

(56) References Cited

U.S. PATENT DOCUMENTS

| | | | | |
|---|---|---|---|---|
| 1,558,506 A | | 10/1925 | Riek | |
| 1,622,422 A | | 3/1927 | Conwell et al. | |
| 2,487,507 A | | 11/1949 | Zalkind | |
| 3,033,639 A | | 5/1962 | Emery | |
| 3,371,968 A | * | 3/1968 | Loake | 312/333 X |
| 3,722,975 A | | 3/1973 | Taylor | |
| 3,876,270 A | | 4/1975 | White | |
| 4,061,375 A | * | 12/1977 | Mertes | |
| 4,272,139 A | * | 6/1981 | Fler | 312/333 X |
| 4,305,625 A | | 12/1981 | Gutner et al. | |
| 4,376,555 A | | 3/1983 | Grass | |
| 4,387,942 A | | 6/1983 | Lense | |
| 4,501,453 A | | 2/1985 | Gutner et al. | |
| 4,765,699 A | * | 8/1988 | Bessinger et al. | |
| 4,872,734 A | * | 10/1989 | Rechberg | 312/333 |
| 5,046,861 A | | 9/1991 | Tarver | |
| 5,056,879 A | | 10/1991 | Röck et al. | |
| 5,244,272 A | | 9/1993 | Thompson | |
| 5,248,195 A | | 9/1993 | Shin | |
| 5,350,229 A | | 9/1994 | Smed | |
| 5,403,097 A | | 4/1995 | Woof | |
| 5,421,653 A | | 6/1995 | Triplette | |
| 5,671,988 A | * | 9/1997 | O'Neill | 312/334.44 |
| 6,076,906 A | | 6/2000 | Royal | |

FOREIGN PATENT DOCUMENTS

| | | | | |
|---|---|---|---|---|
| DE | 2645667 | * | 4/1978 | 312/333 |

* cited by examiner

*Primary Examiner*—Janet M. Wilkens
(74) *Attorney, Agent, or Firm*—Barnes & Thornburg

(57) ABSTRACT

A slide assembly for a drawer to be received in a frame includes a channel formed to include a detent, a slide member having a tab, and a carriage disposed within the channel for longitudinal movement therein. The carriage includes a flexible finger and a stop configured to contact the detent to limit travel of the carriage relative to the channel. The slide member is configured to be longitudinally moveably received within the carriage and the flexible finger limits the outward travel of the slide member by contacting the tab when the slide member is received within the carriage.

20 Claims, 5 Drawing Sheets

DRAWER SLIDE

BACKGROUND AND SUMMARY

This invention relates generally to drawer slides. More particularly, this invention relates to drawer slides having a component for attachment to a drawer and a component for attachment to a frame whereby when the drawer is received in the frame a stop is actuated to permit removal of the drawer from the frame.

Drawer slides are known having components for attachment to a drawer and components for attachment to a frame within which the drawer is to be received. Often such drawer slides include retention and release mechanisms that retain the drawer component within the frame component or vice versa until the release mechanism is actuated. Often the retention and release means are difficult to operate or of complicated manufacture.

The drawer slide assembly disclosed herein is easily operable and of simple manufacture.

A drawer slide assembly in accordance with the present invention includes a channel, a slide member or rail, and a carriage. The channel has an outward first end and an inward second end and is formed to include a detent. The slide member has an outward first end, an inward second end, and a tab. The carriage is disposed within the first channel for longitudinal movement therein. The carriage includes a flexible finger and a stop. The stop is configured to contact the detent whereby the travel of the carriage is limited relative to the channel. The slide member is configured to be longitudinally moveably received within the carriage. When the slide member is received within the carriage, the flexible finger limits the outward travel of the slide member by contacting the tab.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
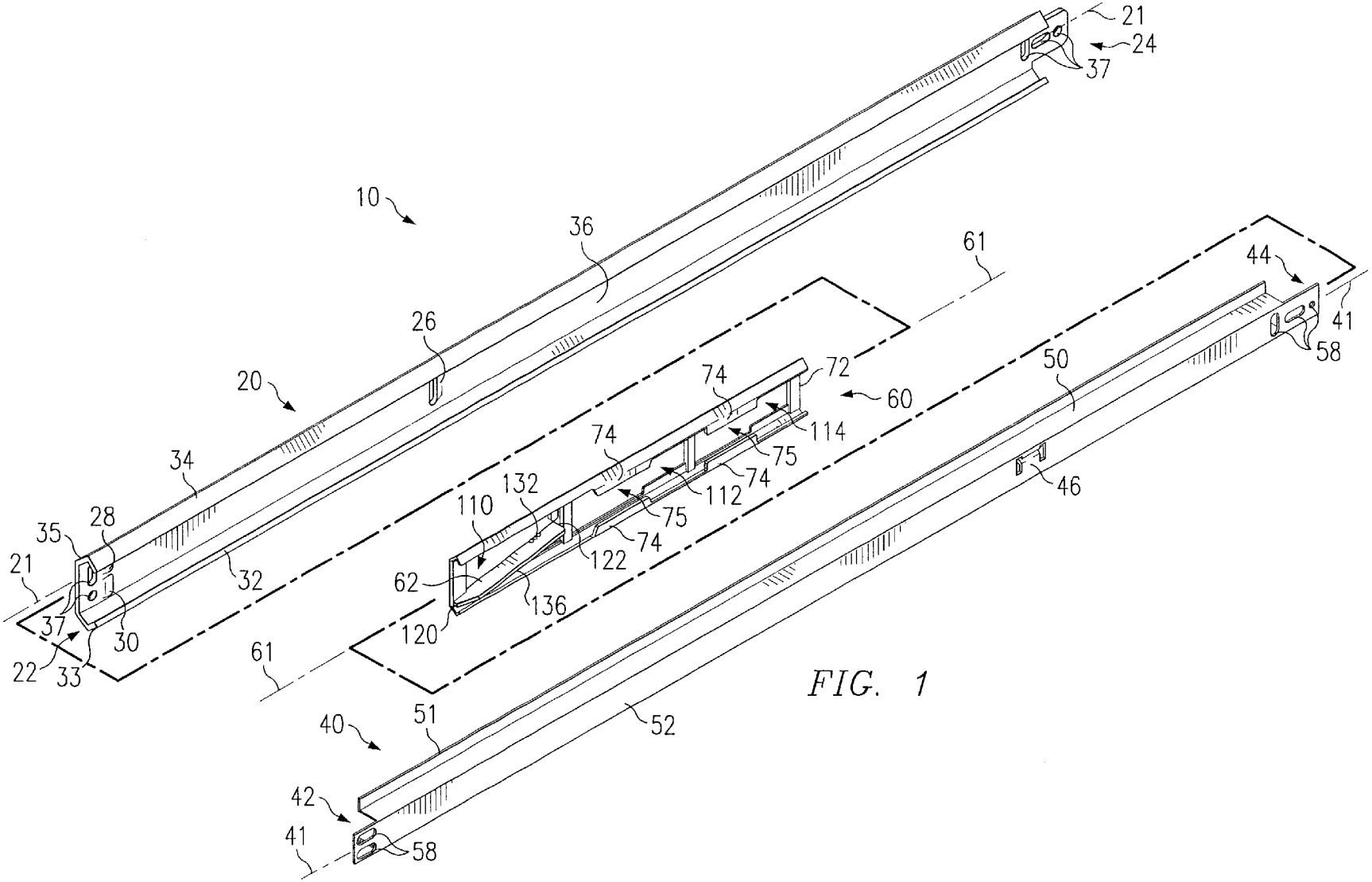
FIG. 1 is an exploded view of the slide assembly showing a relative position of a channel, a carriage, and a rail.

An illustrative embodiment of a drawer slide assembly 10 in accordance with the present invention is shown in FIG. 1. Drawer slide assembly 10 includes a channel 20, a carriage 60, and a rail 40, which cooperate to form assembly 10. Further reference is made to FIG. 12 which shows assembly 10 in cooperation with a drawer 80 and a frame 90.

Figure 12:
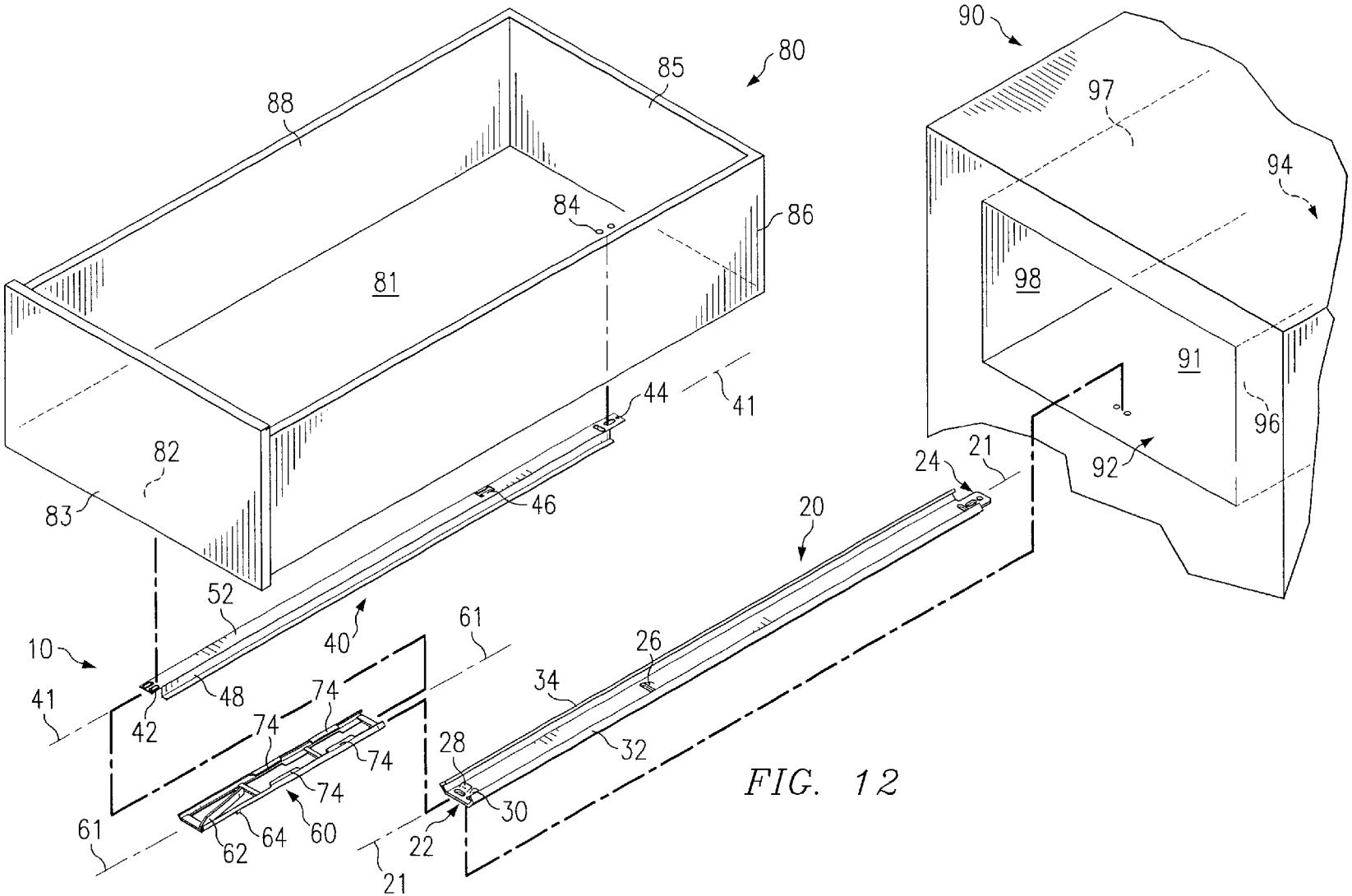
FIG. 12 is an exploded view of the slide assembly in combination with a drawer and a frame.

Referring to FIG. 12, drawer slide assembly 10, drawer 80, and frame 90 are illustrated in an exploded view. Rail 40 of drawer slide assembly 10 slides within carriage 60. Drawer 80 includes a bottom panel 81, first and second side panels 86, 88, respectively, face panel 83, and rear panel 85 cooperating to form an upwardly opening cavity. Frame 90 includes a drawer opening defined by upwardly facing surfaces 91, opposed inwardly facing side surfaces 96, 98, and a downwardly facing surface 97. Drawer opening is sized to receive bottom panel 81, first side panel 86, second side panel 88, and rear panel 85 of drawer 80 therein. As shown, in FIG. 12, channel 20 is configured for attachment to frame 90 and rail 40 is configured for attachment to drawer 80. Carriage 60 rides within channel 20 and rail 40 rides in carriage 60 to facilitate movement of drawer 80 relative to frame 90.

Carriage 60 includes flexible finger 62, a stop 64 to contact at least one of the detents 26,28, 30 whereby the travel of carriage 60 is limited relatively to channel 20. Rail 40 is disposed within carriage 60 and is longitudinally moveable therein. Flexible finger 62 limits the outward travel of rail 40 by contacting tab 46. Thus, when used in cooperation with drawer 80 and frame 90 as shown in FIGS. 1 and 12, drawer 80 may slide freely within frame 90 but flexible finger 62 in cooperation with tab 46 stops drawer 80 from inadvertently traveling beyond the confines of frame 90. Although the illustrated embodiment shows assembly 10 in an undermount position relative to drawer 80, it is to be understood by those skilled in the art that the present invention is envisioned to be equally applicable to mounting on sides 86, 88 of drawer 80 and sides 96 and 98 of frame.

Those skilled in the art will recognize that drawer slide assembly 10 is depicted having channel or first track 20 attached to upwardly facing surface 91 of frame 90 and rail or second channel 40 attached to underside of bottom panel 81 of drawer 80. By such arrangement, drawer slide assembly 10 is illustrated as being mounted as an under drawer slide. The terms upwardly, downwardly, inwardly and outwardly, and similar adverbial or adjectival terms will be used herein in describing drawer slide assembly 10 with the understanding that those terms accurately reflect the orientation of components of drawer slide assemblies mounted as under drawer slides. However, the usage of such directional terms is not intended to limit the scope of the invention to under drawer slides, since it is within the scope of the disclosure as presently perceived to mount drawer slide assembly 10 to drawer 80 and frame 90 in different fashions, eg mounting a single drawer slide assembly to a side panel 86 or 88 of drawer 80, mounting a drawer slide assembly to each side panel 86 and 88 of drawer 80, etc.

Channel or outer track 20 has a first end 22, a second end 24, a bottom portion 36, a first side flange 32, and a second side flange 34. Bottom portion 36 is formed to include at least one detent 30. In the illustrated embodiment, two additional detents 26 and 28 are shown but it is to be understood that multiple detents are not necessary. Referring to FIG. 12, the exploded view indicates that in use, first end 22 of channel 20 is attached to an outward, proximal portion 92 of frame 90 and second end 24 of channel 20 is attached to an inward, distal portion 94 of frame 90.

Figure 11:
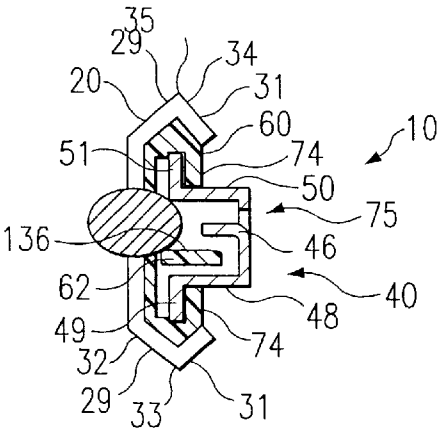
FIG. 11 is a sectional view taken along the line 11—11 of FIG. 10 showing the channel, carriage, stop, rail, tab, and the flexible finger in the second, flexed position.
Figure 9:
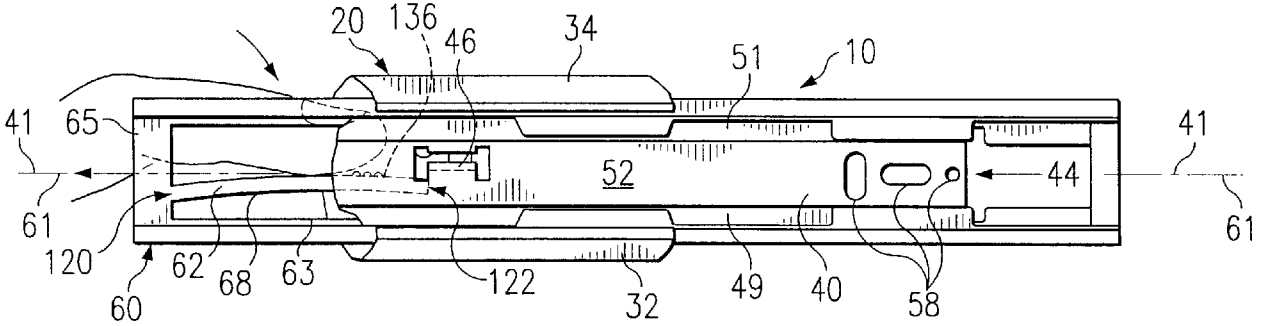
FIG. 9 is a partial overhead plan view of the assembly showing the flexible finger moved to a second, flexed position.
Figure 10:
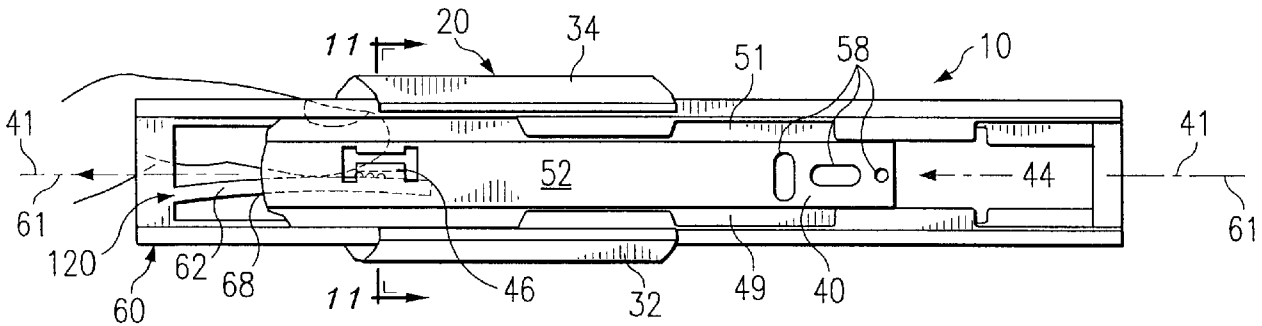
FIG. 10 is a partial overhead plan view of the assembly showing the flexible finger moved to the second, flexed position and the tab moved in a proximal direction beyond the flexible finger.

Referring to FIGS. 1 and 11, channel or outer track 20 is illustrated. Illustratively, channel 20 is formed from a metallic material which is formed and stamped to create the features of channel 20. First side flange 32 and second side flange 34 are spaced-apart with bottom portion 36 extending therebetween. Bottom portion 36 is substantially planar along the length and width of channel 20 to facilitate secure fastening of channel 20 to frame 90. Bottom portion 36 is formed to include attachment holes 37 extending therethrough within which fasteners (not shown) are received for fastening channel 20 to frame 90.

Illustratively, bottom portion 36 of channel 20 is formed to include two upwardly extending outward detents 28 and 30 adjacent first end 22 of channel 20 and an upwardly extending medial detent 26 disposed between outward detents 28 and 30 and second end 24. Illustratively, detents 26, 28, 30 are stamped in bottom portion 20. Outward detents 28, 30 incline rearwardly while medial detent 26 inclines forwardly.

In the illustrated embodiment, the metallic material of channel 20 is bent to form first side flange 32 and second side flange 34. As shown in FIG. 11, first and second side flanges 32 and 34, respectively, include a first portion 29 extending laterally outwardly and upwardly (assuming channel 20 is mounted to an upwardly facing surface of frame 90) from side edges of bottom portion 20 and a second portion 31 extending inwardly and upwardly from first portion 29. As shown for example in FIG. 11, channel has a substantially diamond C-shaped cross-section.

Slide member, inner track, or rail 40 has a first end 42, a second end 44, a top portion 52, a first side wall 48, a second side wall 50, and outwardly extending lips 49 and 51. First side wall 48 and second side wall 50 are spaced-apart with top portion 52 extending therebetween. Illustratively, top portion 52 is substantially planar to facilitate attachment of rail 40 to the underside of bottom panel 81 of drawer 80. First end 42 of rail 40 is attached to an outward, proximal portion 82 of drawer 80 and second end 44 of rail 40 is attached to an inward, distal portion 84 of drawer 80. Carriage 60, also shown in FIGS. 2 and 3, is disposed within the channel 20 and is longitudinally moveable therein.

A lip 49, 51 extends outwardly from the bottom end of each of first and second walls 48 and 50, respectively. Rail 40 is substantially symmetrical about its longitudinal axis 41. Top portion 52 is formed to include attachment holes 58 through which fasteners (not shown) extend to attach rail 40 to drawer 80. As shown in FIG. 11, rail 40 has a substantially box U-shaped or box Q-shaped cross section. Like channel 20, rail 40 is illustratively formed of a metallic material to facilitate forming of part through standard stamping, cutting and bending operations. Those skilled in the art will recognize that rail 40 and channel 20 can be made from non-metallic materials within the scope of the invention.

Top portion 52 is formed to include a downwardly projecting tab 46. Illustratively, tab 46 is formed by cutting or stamping a laterally extending strip in top portion 52, cutting strip near second side wall 50 and bending strip near longitudinal axis 41 so that tab 46 extends downwardly adjacent longitudinal axis 41.

Figure 2:
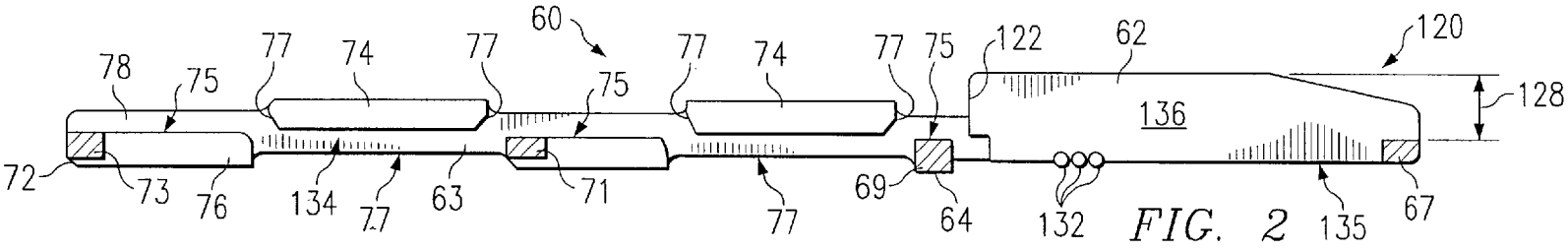
FIG. 2 is a side sectional view along line 2—2 of FIG. 3 of the carriage showing the base, the guides, a stop, and a flexible finger.
Figure 3:
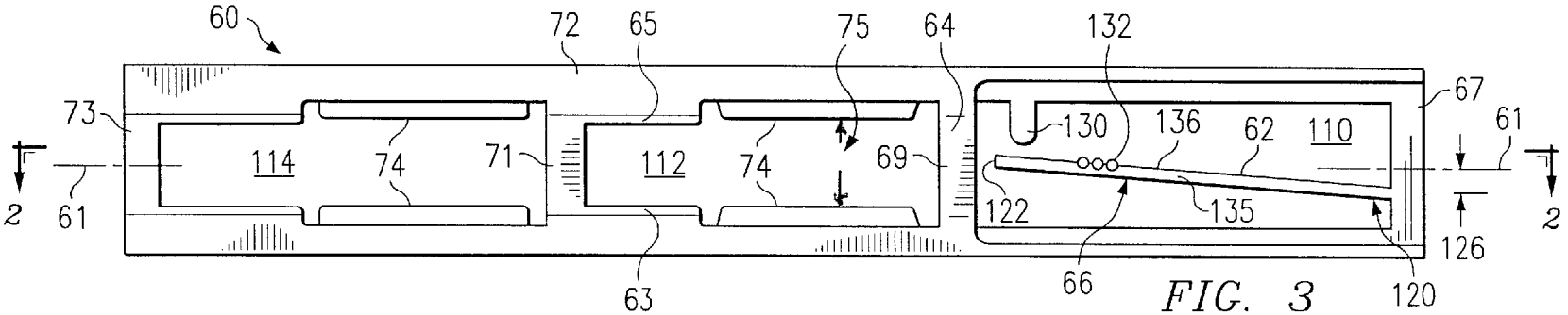
FIG. 3 is a bottom plan view of the carriage.

Referring now to FIGS. 2, 3, and 11 in one embodiment carriage 60 is formed to include a base 72, pairs of guide tabs 74, and a flexible finger 62. Base 72 includes a bottom portion 76, a top portion 78, and a stop 74 projecting from bottom portion 76. Illustratively, bottom portion 76 of base 72 has atop surface 75 and a bottom surface 77 and is formed from longitudinally extending first and second sides 63 and 65, respectively, and crossmembers 67, 69, 71, 73. Front crossmember 67, forward middle cross member 69, first side 63, and second side 65 define a front rectangular opening 110. Forward middle cross member 69, rearward middle cross member 71, first side 63, and second side 65 define a middle rectangular opening 112. Rearward middle cross member 71, rear cross member 73, first side 63, and second side 65 define a rear rectangular opening 114. Those skilled in the art will recognize that front rectangular opening 110 provides free space within which finger 62 may be flexed and thus the rectangular shape of the opening should not act as a limitation on the scope of the disclosure. Middle and rear rectangular openings 112 and 114, respectively and areas of front rectangular opening 110, serve merely to reduce the material requirements of carriage 60.

Figure 5:
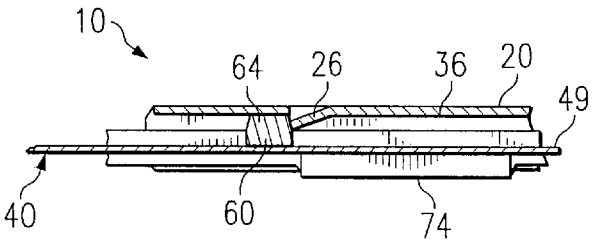
FIG. 5 is a partial sectional view taken along the line 5—5 of FIG. 4 showing a position of the carriage relative to the channel, a tab, and the flexible finger.
Figure 4:
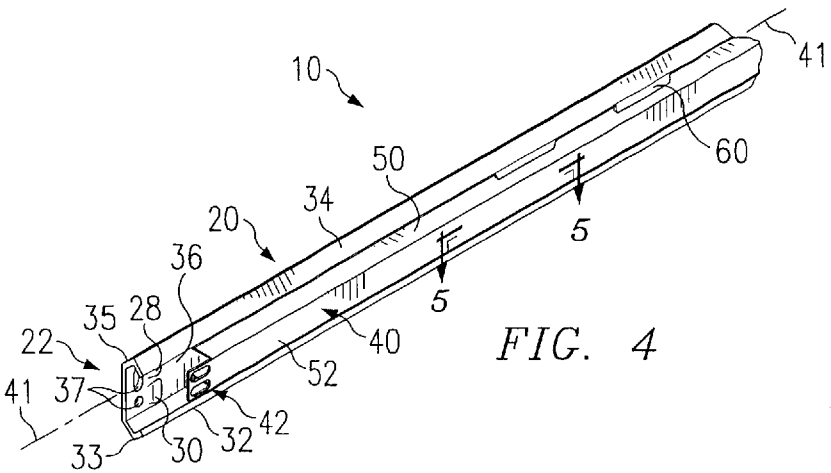
FIG. 4 is a perspective view of the slide assembly in an assembled state showing a relative position of the channel, the carriage, and the rail.
Figure 6:
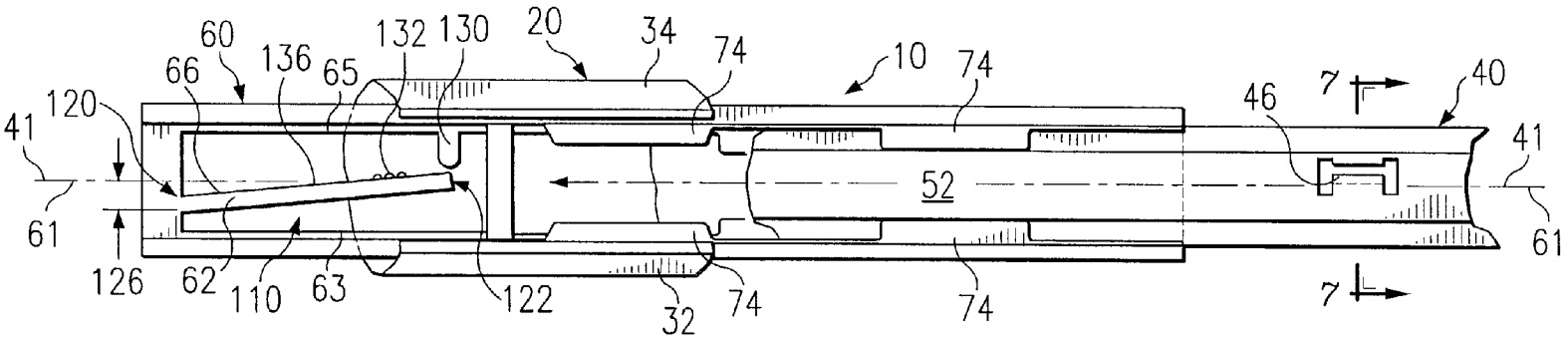
FIG. 6 is a partial overhead plan view of the assembly showing the flexible finger in a first, national position.
Figure 7:
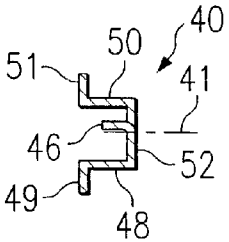
FIG. 7 is a sectional view taken along the line 7—7 of FIG. 6 showing the tab.
Figure 8:
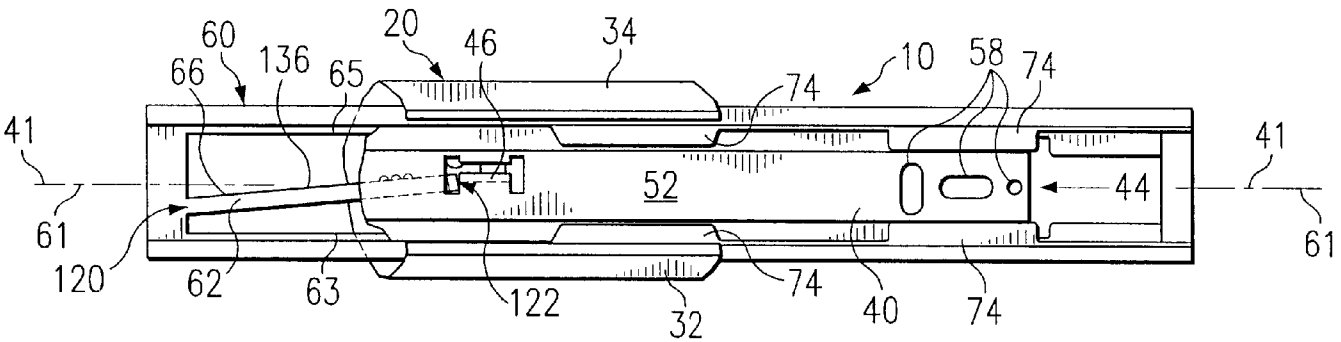
FIG. 8 is a partial overhead plan view of the assembly showing the flexible finger in the first, natural position in contact with the tab.

Base 72 is formed to include a stop 64 projecting downwardly from bottom surface 77 of bottom portion 76. As shown in FIG. 5, Stop 74 is preferably formed to have sharp edges to engage detent 30 to limit the travel of carriage 60 within channel 20. In the illustrated embodiment, stop 64 is a transverse ridge extending downwardly from forward middle cross member 69.

Top portion 78 extends upwardly from top surface 75 of first and second sides 63 and 65, respectively. Top portion 78 includes a plurality of pairs of guide tabs 74 extending laterally inwardly toward longitudinal axis 61. Each pair of guide tabs 74 are positioned to be in spaced-apart and confronting relationship to one another on opposite sides of the carriage 60 to define a track 75 therebetween within which side walls 48 and 50 and top portion 52 of rail 40 are slidably received for longitudinal movement relative to carriage 60. Outwardly extending lips 49, 51 of rail 40 are slidably disposed within carriage 60 between the bottom surface of associated guide tabs 74 and top surface 77 of sides 63 and 65 of bottom portion 76. The pairs of guide tabs 74 are positioned to define a track 75 for receipt of rail 40.

Carriage 60 is configured to be disposed within channel 20 for longitudinal movement therein. Illustratively, carriage 60 is slidably embraced by angled blades 33 and 35 of side flanges 32 and 34. As shown, for example, in FIG. 11 carriage 60 has a diamond C-shaped cross section facilitating receipt of carriage 60 within channel 20.

In the illustrated embodiment, when carriage 60 is disposed within channel 20, carriage 60 is free to move longitudinally within channel 20 between limits. Stop 64 of carriage 60 and both front detents 30 and 28 of channel 20, upon contact, cooperate to limit the outward movement of carriage 60 relative to channel 20. Those skilled in the art will recognize that outward movement of carriage 60 within channel 20 may be limited by transverse ridge contacting a single front detent or by other properly configured structural elements of carriage 60 and channel 20. Stop 64 of carriage 60 and medial detent 26 of channel 20, upon contact, cooperate to limit inward movement of carriage 60 with respect to channel 20.

As previously stated, carriage 60 is further formed to include flexible finger 62 which cooperates with tab 46 of rail 40 to selectively limit outward movement of rail 40 with respect to carriage 60. Illustratively, flexible finger 62 includes a fixed end 120 and a free end 122. Fixed end 120 is attached to front cross member 67 so as to be offset from longitudinal axis 61 toward first side 63 by a distance 126 sufficient to allow tab 46 of rail 40 to slide past fixed end 120 without interference from fixed end 120 when rail 40 is inserted into track 75 of carriage 60. Finger 62 extends upwardly from bottom portion 76 a distance 128 sufficient to allow a portion of free end 122 to engage a portion of tab 46. Finger 62 extends longitudinally from fixed end 120 to free end 122 which is displaced toward second end 24 of channel 20 when the carriage 60 is disposed within channel 20. Finger 62 extends laterally inward toward longitudinal axis 61 from fixed end 120 toward free end 122 so that free end 122 is disposed adjacent longitudinal axis 61 when finger 62 is in its natural, first position 66.

Finger 62 is disposed within front rectangular opening 110 to permit finger 62 to be flexed laterally. Illustratively, a stop 130 extends from second side 65 of bottom portion 76 inwardly into front rectangular opening 110 to restrict flexation of finger 62 so that finger 62 can only be flexed toward first side 63. Raised tactile indicators 132 are formed on the bottom 135 and second side 136 of finger 62 to provide a user with a tactile indicator of the side of finger 62 which should be pushed to flex finger 62 toward first side 63 of bottom portion 76.

In the illustrated embodiment, when finger 62 is in the first natural position 66, and rail 40 is slidably received in carriage 60, free end 122 of the finger 62 lies along a common longitudinal axis 41,61 with tab 46. As rail 40 is moved outwardly with respect to carriage 60, tab 46 engages free end 122 of flexible finger 62 when finger 62 is in the first natural position 66 to limit outward motion of rail 40 with respect to carriage 60. When finger 62 is in flexed position 68, tab 46 moves freely beyond the finger 62 to allow rail 40 to be removed from carriage 60 and thus allow drawer 80 to be removed from frame 90.

In a preferred embodiment, guide tabs 74 include chamfered edges 77. (Best seen in FIG. 2.) Also in a preferred embodiment, carriage 60 is formed from high density polyethylene (HDPE). HDPE is especially suited to this application since it is a relatively inexpensive material, easily formed, durable and self-lubricating in the instant application. However, those skilled in the art will recognize that carriage may be manufactured from other materials within the scope of the invention.

In use, channel 20 is attached to frame 90 by nails, screws, staples, or other suitable fasteners (not shown). Channel 20 is positioned on frame 90 such that detents 26, 28, 30 face upward. Detents 28, and 30 which are formed at the first end 22 of the channel 20, are at the outward, proximal position 92 of the frame 90. In a preferred embodiment, a third detent 26 is formed between first end 22 and second end 24 of channel 20.

In use, rail 40 is attached to drawer 80 by nails, screws, staples, or other suitable means (not shown). Rail 40 is positioned on drawer 80 such that tab 46 faces downward when drawer 80 is in its normal position.

Referring to FIGS. 6–10, carriage 60 is slidably received in channel 20 and rail 40 is slidably received within guide tabs 74. In the preferred embodiment, stop 64 rides up over the inclined portion of detents 28, 30 formed at first end 22 of channel 20. Carriage 60 is slidably and limitedly disposed within the channel 20 to move between an outer limit and an inner limit. When the carriage 60 slides outwardly, stop 64 strikes detents 28, 30 and outward travel of carriage 60 is limited. When carriage 60 slides inwardly, stop 64 strikes detent 26 and the inward travel of the carriage 60 is limited.

To mount the drawer 80 within the frame 90, rail 40 is slidably disposed within track 75 defined by guide tab pairs 74 of carriage 60. As drawer 80 with attached rail 40 is slid into track 75, tab 46 urges flexible finger 62 from its first, natural position 66 to its second, flexed position 68. When finger 62 is in its flexed position 68, finger 62 passes beyond tab 46. After tab 46 passes beyond flexible finger 62, flexible finger 62 returns to its first, natural position 66. It will be appreciated by those skilled in the art, that the placement of detents 26, 28, 30 in combination with the dimensions of carriage 60 and the placement of stop 64 and flexible finger 62 may be designed to control the degree of travel of drawer 80 relative to frame 90.

In operation, assembly 10 provides a smooth mechanism for aligning drawer 80 in frame 90 and maintaining the position of drawer 80 within frame 90. When installed, drawer 80 is constrained from traveling outwardly by contact between flexible finger 62 and tab 46. Conveniently, when it is desirous to remove the drawer 80 from frame 90, manual movement of flexible finger 62 from first, natural position 66 where it is in longitudinal alignment with tab 46 to the second, flexed position 68 where it is not in longitudinal alignment with tab 46 enables drawer 80 to be removed from frame 90.

Those skilled in the art will recognize that during insertion of drawer 80 into frame 90, lips 49, 51 of rail 40 are inserted into a gap 134 between bottom surface of guides 74 and top surface 63 of bottom portion of carriage 60, and rail 40 is slid rearwardly within carriage 60. Initially carriage 60 slides rearwardly within channel until stop 64 engages medial detent 26 while lips 49, 51 of rail 40 slide within guide gaps 134. During insertion of rail 40 into track 75 of carriage 60, tab 46 eventually engages second side 136 of finger between fixed end 120 and free end 122. Upon further insertion, tab 46 urges finger 62 to flex toward first side 63 of carriage 60 until tab 46 passes inwardly beyond free end 122 of flexible finger 62. Upon tab 46 passing inwardly beyond free end 122 of flexible finger 62, flexible finger 62 returns to its natural first position 66.

Although the invention has been described in detail with reference to a certain preferred embodiment, variations and modifications exist within the scope and spirit of the present invention as described and defined in the following claims.

What is claimed is:

1. A slide assembly for a drawer to be received in a frame, the assembly comprising:

a channel having an outward first end and an inward second end and formed to include a detent;

a slide member having an outward first end and an inward second end and a tab;

a carriage disposed within the first channel for longitudinal movement therein, the carriage including a flexible finger, the carriage further including a stop configured to contact the detent whereby the travel of the carriage is limited relative to the channel; and wherein the slide member is configured to be longitudinally moveably received within the carriage and the flexible finger limits the outward travel of the slide member by contacting the tab when the slide member is received within the carriage.

2. The slide assembly of claim 1, wherein the slide member is attached to a bottom panel of the drawer.

3. The slide assembly of claim 2, wherein the first end of the slide member is configured to be attached to an outward, proximal portion of the drawer and the second end of the slide member is configured to be attached to an inward, distal portion of the drawer.

4. The slide assembly of claim 3, wherein the first end of the channel is configured to be attached to an outward, proximal portion of the frame and the second end of the channel is configured to be attached to an inward, distal portion of the frame.

5. The slide assembly of claim 1, wherein the slide member is removable from the carriage when the flexible finger is moved aside from the tab.

6. The slide assembly of claim 1, wherein the stop is a transverse ridge.

7. The slide assembly of claim 1, wherein the carriage is high density polyethylene.

8. The slide assembly of claim 1, wherein the flexible finger is in a first, natural position to limit the outward travel of the slide member by contacting the tab and whereby the flexible finger is moveable to a second, flexed position whereby the outward travel of the slide member is not limited.

9. The slide assembly of claim 8, wherein upon receipt of the slide member within the carriage, the slide member is removable from the carriage.

10. A slide assembly for a drawer in a frame, the assembly comprising:

an outer track having a first end and a second end, the outer track formed to include a first side flange, a second side flange in spaced-apart relation to the first side flange, and a bottom portion therebetween, the bottom portion including at least one detent;

a rail having a first end and a second end, the rail formed to include a first side wall, a second side wall in spaced-apart relation to the first side wall, and a top portion therebetween, the top portion including a tab projecting from the top;

a carriage disposed within the track for reciprocal inward and outward movement relative thereto, the carriage including a stop to contact the detent wherein the detent and stop cooperate to limit the outward movement of the carriage relative to the track, the carriage including a flexible finger, the flexible finger having a free end pointing generally toward the second end of the track when the carriage is disposed within the track; the carriage being configured to receive the rail for inward and outward reciprocal movement relative thereto; and whereby when the rail is disposed within the carriage the flexible finger limits the outward travel of the rail by contacting the tab.

11. The slide assembly of claim 10, wherein the carriage is slidably embraced by the side flanges.

12. The slide assembly of claim 10, wherein each of the flanges are formed to include an angled blade.

13. The slide assembly of claim 10, wherein each of the side walls are formed to include a lip.

14. A slide assembly for a drawer and a frame, the assembly comprising:

an outer track having a first end and a second end, the outer track formed to include a first side flange, a second side flange positioned to lie in spaced-apart relation to the first side flange, and a bottom portion therebetween, each of the flanges formed to include an angled blade, the bottom portion formed to include at least one detent;

an inner track having a first end and a second end, the inner track formed to include a first side wall, a second side wall positioned to lie in spaced-apart relation to the first side wall, and a top portion therebetween, each of the side walls formed to include a lip, the top portion formed to include a tab projecting downward from the top portion;

a carriage formed to be slidably disposed within the outer track, the carriage being slidably embraceable by the angled blades, the carriage formed to include a transverse ridge formed to contact the at least one detent whereby the travel of the carriage is limited, the carriage further formed to include a flexible finger, the flexible finger having a free end pointing generally toward the second end of the outer track when the carriage is disposed within the outer track, the carriage being further formed to receive the lips of the inner track; and wherein when the lips are slidably disposed within the carriage the flexible finger limits the travel of the inner track by contacting the tab.

15. A drawer slide assembly for use in an apparatus having a frame having an outward, proximal portion and an inward, distal portion and a drawer having an outward, proximal portion and an inward, distal portion, the drawer slide assembly comprising:

a first channel having a first end and a second end and formed to include at least one detent, wherein the first end of the first channel is attached to the outward, proximal portion of the frame and the second end of the first channel is attached to the inward, distal portion of the frame;

a second channel having a first end and a second end and formed to include a tab, wherein the first end of the second channel is attached to the outward, proximal portion of the drawer and the second end of the second channel is attached to the inward, distal portion of the drawer;

a carriage formed to include a base having a bottom portion and a top portion, the base formed to include a stop projecting from the bottom portion, at least one pair of guide tabs appended to the top portion and positioned to be in spaced-apart and confronting relationship to one another on opposite sides of the base and defining a track therebetween, and a flexible finger; and wherein the carriage is slidably disposed at least partially within the first channel and the second channel is slidably disposed within the track and whereby the travel of the carriage within the first channel is limited by the stop contacting one or more detents and the travel of the second channel is limited by the flexible finger contacting the tab.

16. The drawer slide assembly of claim 15, wherein the drawer is removable from the frame when the flexible finger is moved aside from the tab.

17. The drawer slide assembly of claim 15, wherein the flexible finger has a natural, first position and at least one flexed position and whereby when the flexible finger is in its natural, first position, an end of the finger lies along a common longitudinal axis with the tab and whereby when the finger is in the flexed position the tab moves freely beyond the finger.

18. A drawer slide carriage for use in an apparatus having a first track formed to include a detent and a rail formed to include a tab, the carriage comprising:

a base formed to be slidably disposed within the first track, the base having a lower portion and an upper portion, the lower portion engaging the first track;

a stop projecting from the base for contacting the detent in the first track whereby the travel of the carriage in the first track is limited;

at least one pair of guide tabs appended to the upper portion of the base and positioned in spaced-apart and confronting relationship to one another on opposite sides of the base and defining a second track therebetween adapted to receive the rail; and a flexible finger formed to contact the tab formed in the rail whereby the travel of the rail in the second track is limited.

19. A drawer slide assembly for slidably coupling a frame formed to include an outward, proximal portion and an inward, distal portion to a drawer formed to include an outward, proximal portion and an inward, distal portion, the drawer slide assembly comprising:

a first track having a first end and a second end, the first track formed to include at least one detent, wherein the first end of the first track is attached to the outward, proximal portion of the frame and the second end of the first channel is attached to the inward distal portion of the frame;

a rail having a first end and a second end and formed to include a tab, wherein the first end of the rail is attached to the outward, proximal portion of the drawer and the second end of the rail is attached to the inward, distal portion of the drawer;

a carriage formed to include a base, the base formed to include a stop projecting therefrom, at least one pair of guide tabs appended to a top portion of the base and positioned to be in spaced-apart and confronting relationship with one another on opposite sides of the base and defining a second track therebetween;

wherein the carriage is slidably disposed within the first track and whereby the travel of the carriage within the first track is limited by the stop contacting the detent, and the travel of the rail is limited by the flexible finger contacting the tab.

20. A method of removably limiting outward travel of a drawer slidably mounted in a frame, the method including the steps of:

attaching a first track having at least one detent to the frame;

attaching a rail having a tab to the drawer;

slidably disposing a carriage having a second track, a flexible finger, and a stop into the first track for movement thereby; and slidably disposing the rail into the second track whereby the outward travel of the drawer is arrested when the tab contacts the flexible finger and whereby flexing the finger enables the drawer to be removed from the frame.

* * * * *